US005196649A

United States Patent [19]

DiRubbio et al.

[11] Patent Number: 5,196,649

[45] Date of Patent: Mar. 23, 1993

[54] SAFETY FUZE FOR A HAND GRENADE

[75] Inventors: Vincent DiRubbio, Perry, Fla.; Edmund Galinski, Newton, N.J.

[73] Assignee: DiNova, Inc., Perry, Fla.

[21] Appl. No.: 802,176

[22] Filed: Dec. 4, 1991

[51] Int. Cl.[5] ..... F42B 27/08

[52] U.S. Cl. ..... 102/486; 102/487

[58] Field of Search ..... 102/486, 487, 488, 402, 102/204

[56] References Cited

U.S. PATENT DOCUMENTS

| | | | |
|---|---|---|---|
| 2,042,461 | 6/1936 | Gibson et al. | 102/487 |
| 2,421,762 | 6/1947 | Short | 102/487 |
| 2,437,001 | 3/1948 | Petersen | 102/487 |
| 2,562,928 | 8/1951 | Lewis | 102/483 |
| 2,911,913 | 11/1959 | Sunden | 102/487 |
| 3,505,959 | 4/1970 | Lohnert et al. | 102/487 |
| 3,603,257 | 9/1971 | White et al. | 102/487 |
| 3,731,631 | 5/1973 | Berlin et al. | 102/403 |
| 4,369,708 | 1/1983 | Bryan et al. | 102/202.13 |
| 4,383,470 | 5/1983 | Assmann | 102/402 |
| 4,506,606 | 3/1985 | Caruso | 102/482 |
| 4,513,667 | 4/1985 | Caruso | 102/482 |
| 4,699,063 | 10/1987 | Aschwanden et al. | 102/482 |
| 4,926,752 | 5/1990 | DiRubbio et al. | 102/486 |

FOREIGN PATENT DOCUMENTS

| | | |
|---|---|---|
| 1147516 | 4/1963 | Fed. Rep. of Ge many . |
| 2500619 | 8/1982 | France . |
| 2059553 | 4/1981 | United Kingdom . |

OTHER PUBLICATIONS

"Hand Grenade Fuze M213 Assembly", U.S. Army Armanent Research and Development Command, Dover, N.J., (Mar. 2, 1960).

*Primary Examiner*—David H. Brown

*Attorney, Agent, or Firm*—Mason, Fenwick & Lawrence

[57] ABSTRACT

A safety fuze for a hand grenade comprises a fuze body, a delay case assembly, an initiator lever assembly, and a cover assembly. The fuze body has a head, a stem, and a central portion, and a bore extending longitudinally therethrough. The delay case assembly is matingly received in the bore and includes an upper primer portion containing a primer in a primer holder, and a lower delay portion. A flat, circular seal is interposed between the base of the primer and the primer holder. A first annular seal is matingly received in a first annular channel defined between the primer holder and the delay case. A second annular seal is matingly received in a second annular channel defined between the delay case assembly and the bore. An annular gasket is matingly received in a third annular channel formed in the bottom wall of the central portion of the fuze body. The initiator lever assembly comprises an elongated initator lever rotatably mounted to the fuze body head and a cover assembly removably mounted to the fuze body head using a hinge and hinge slot assembly. A rotatable safety latch is mounted on the cover assembly to maintain the initiator lever in its unprimed position. A projection on the initiator lever engages the safety latch to prevent its rotation. For a practice grenade, the bottom of the fuze body is open, with the delay case assembly extending therethrough and frictionally engaged by an annular gasket matingly received in a fourth annular channel formed in the inner surface of the stem.

21 Claims, 4 Drawing Sheets

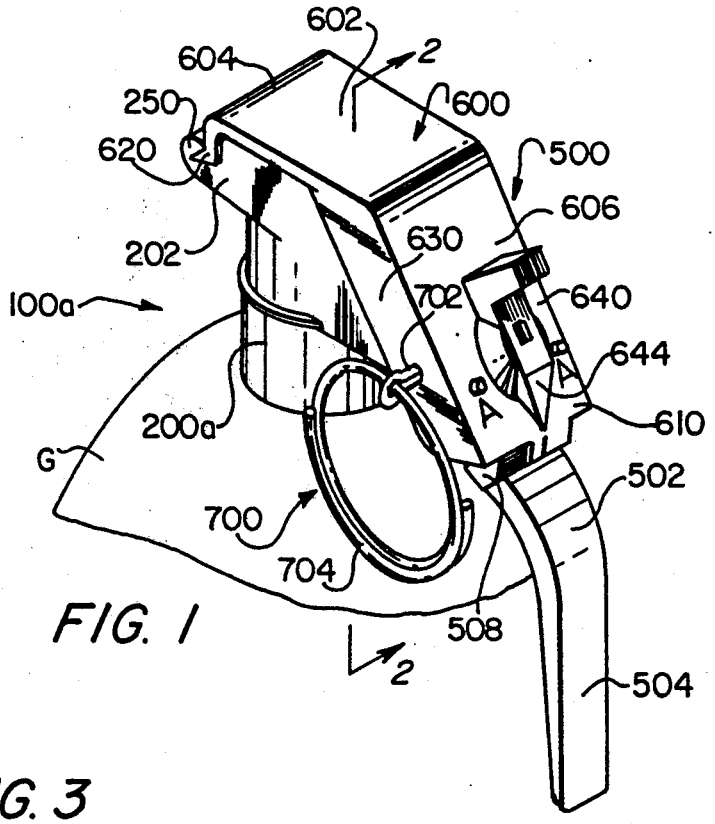
FIG. 1
FIG. 3
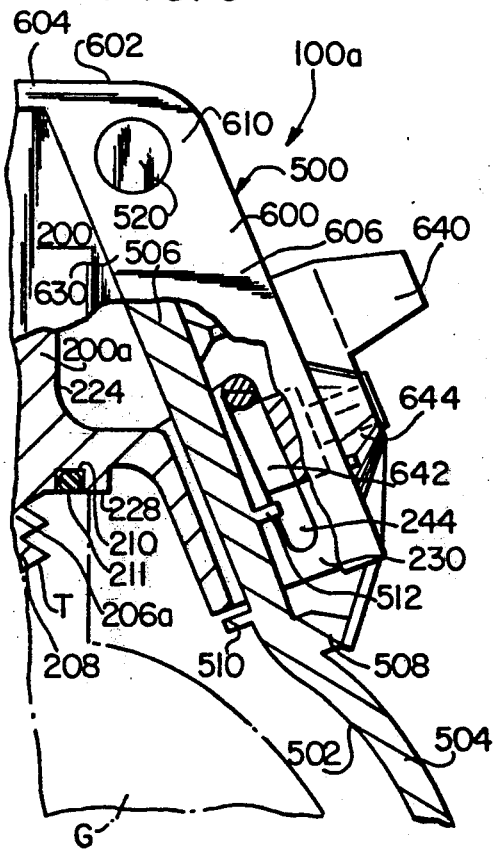
FIG. 4
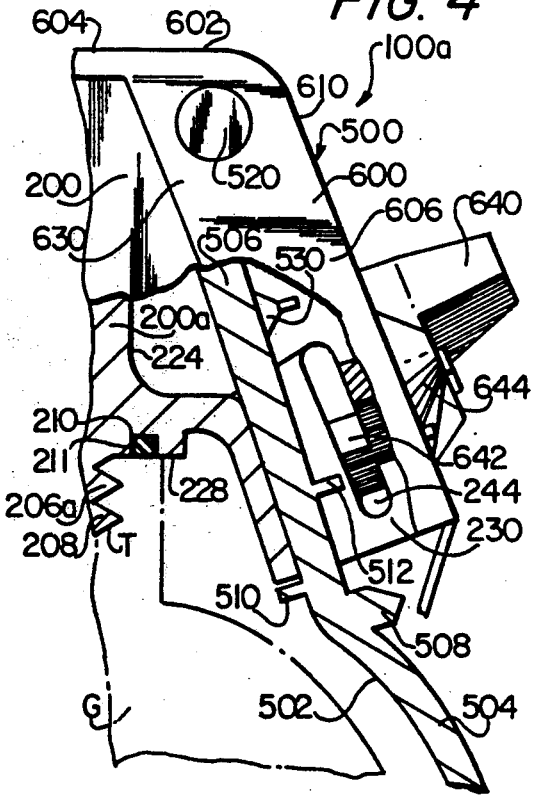

SAFETY FUZE FOR A HAND GRENADE

BACKGROUND OF THE INVENTION

1. Field of the Invention

The present invention is directed to the field of grenades, and more specifically to a safety fuze for use with hand grenades.

2. Related Art

The hand grenade presently in use by the U.S Department of Defense is the M213, shown in U.S. Pat. No. 2,562,928 to Lewis. The hand grenade fuze 8 incorporates a number of features standard in hand grenades and similar, hand thrown, fuze-activated devices. For example, a safety pin or pull ring assembly 100 is inserted through the lever 92, through apertures in the fuze body 12, over the striker assembly 70 to restrain the striker assembly 70 in the safe position. Also, a safety clip (not shown) commonly is fastened around the lever 92 and an extension (not shown) of the fuze body 12 to prevent accidental, premature release of the lever 92 and the striker assembly 70 if the pull ring assembly 100 was accidently removed.

However, in military situations when silence is of the utmost importance, the user frequently employs the unauthorized, unsafe, procedure of removing the safety clip to avoid detection by the enemy given by the distinctive sound from its removal, or the noise it produces upon impacting objects after being discarded. Also, because of the short length of the striker assembly 70, if the lever 92 is unknowingly released even a slight amount after the pull ring assembly 100 is removed, the striker assembly 70 will be allowed to rotate and the firing pin 84 will hit the primer 28, initiating the firing sequence. As this can occur without the knowledge of the user, the grenade can function while still in the user's hand or attached to an article of clothing.

Most fuze assemblies for hand grenades and the like employ lever and striker assemblies similar to those of the M213. Examples of such assemblies are disclosed in U.S. Pat. No. 2,042,461 to Gibson et al.; U.S. Pat. No. 2,421,672 to Short; U.S. Pat. No. 2,911,913 to Suden; and U.S. Pat. No. 4,513,667 to Caruso.

Another safety problem encountered with the M213 is associated with the firing train assembly; the primer assembly, the delay charge/cavity, and the detonator assembly. In the M213, the detonator charge is in direct fluid communication with the delay charge/cavity in the fuze body stem, and the delay charge/cavity is in direct fluid communication with the primer assembly. An insufficient amount of delay charge can cause a grenade to function, after the firing train has been initiated, in a shorter time than that required of complete delay charge. Also, the absence of any delay charge in the delay cavity can cause an instantaneous functioning of the grenade after the firing train has been initiated. Also, a crack or cracks, or porosity having fluid communication between the interior stem cavity and the outer stem wall of the fuze body, can permit hot gasses to be in like fluid communication with the interior of the detonator assembly. Also, the through fluid communication within the components of the firing train can cause deterioration of the explosive or pyrotechnic components, shortening shelf life and endangering the user who is depending on reliable performance of the device.

Other fuzes for hand grenades employ primer, delay, and detonator assemblies similar to those of the M213, as shown by U.S. Pat. No. 4,383,470 to Assman.

Our U.S. Pat. No. 4,926,752, which is incorporated herein by reference in its entirety, addressed these problems by the provision of a safety fuze for a hand grenade comprising a fuze body, a delay case assembly, a detonator assembly, an initiator lever assembly, a cover assembly, and a pull ring assembly. The delay case assembly comprises a delay case matingly received in the bore of the fuze body stem and has a primer portion adjacent the top and a delay portion adjacent the bottom, a sealant separating the primer portion from the delay portion, a primer positioned in the primer portion, a penetration charge positioned at the bottom of the delay case, a delay charge positioned above the penetration charge, an ignition charge positioned above the delay charge, and an air gap separating the primer portion from the ignition charge.

The detonator assembly of our '752 patent comprises a detonator case which matingly receives the fuze body stem at the top thereof and is in sealing engagement with raised crimped surfaces on the fuze body. An explosive detonator charge is positioned at the bottom thereof. A gap is provided between the fuze body stem bottom and the explosive charge.

In the embodiment shown in FIG. 4 of our '752 patent, the initiator lever assembly is mounted on the fuze body and is rotatable between an unprimed position and a primed position. It comprises an elongated initiator lever mounted at its proximal end to the fuze body head for rotation about a axis perpendicular to its plane of symmetry; a spring for biasing the initiator lever in its primed position; and a firing pin formed integrally with the initiator lever, the firing pin being positioned on the initiator lever to engage the primer when the initiator lever assembly is in its primed position. The initiator lever has such a length that in its primed position, its distal end extends forwardly of the front wall of the fuze body head. The initiator lever is longer than and extends below the cover assembly and defines a handle for holding and throwing the grenade.

The cover assembly of the embodiment shown in FIG. 4 of our '752 patent covers the top and back of the fuze body head and includes a pair of opposed pin-receiving apertures in registration with apertures in the side walls of the fuze body head. A safety latch is mounted on the cover assembly. The safety latch is movable between a first position for retaining the initiator lever in its unprimed position by engaging the apertures in the side walls of the fuze body head and a second position for permitting movement of the initiator lever into its primed position.

The pull ring assembly of the embodiment shown in FIG. 4 of our '752 patent has an elongated retaining pin adapted to be inserted through the apertures in the cover assembly and the side walls of the fuze body head. The retaining pin retains the initiator lever in its unprimed position when inserted through the apertures.

Although the fuzes disclosed in our '752 patent are effective in solving the problems present in the prior art, it was found that the seals in the detonator case assembly were unable to pass the extremely rigid MIL-STD-331 Vacuum-Steam-Pressure Test 106.1 imposed on grenade fuzes by the engineering agency at ARDEC, Picatinny Arsenal, N.J.

In addition, we found that an additional safety mechanism to prevent the unintentional arming of the grenade might be desirable. In the embodiment shown in FIG. 4 of our '752 patent, the pull ring assembly was the only mechanism that prevented an individual from rotating the safety latch, which would permit release of the initiator lever.

Further, we found that it would be desirable to modify the fuze body and the delay case assembly disclosed in our '752 patent so that the delay case assembly is usable as a reusable replacement for the M228 single-use practice fuze presently in use by the U.S. Department of Defense.

It is the solution of these and other problems to which the present invention is directed.

SUMMARY OF THE INVENTION

Therefore, it is the primary object of this invention to provide a safety fuze for a hand grenade which will pass the MIL-STD-331 Vacuum-Steam-Pressure Test 106.1.

It is another object of this invention to provide a safety fuze for a hand grenade which incorporates multiple safety features which prevent the safety latch from being accidentally placed in the armed position.

It is still another object of this invention to provide a reusable safety fuze for a hand grenade which can be used in practice grenades.

These and other objects of the invention are achieved by the provision of a safety fuze for a hand grenade comprising a fuze body, a delay case assembly, an initiator lever assembly, and a cover assembly. The fuze body has a head, a stem, and a central portion, and a bore extending longitudinally therethrough.

The delay case assembly comprises a delay case matingly received in the bore and having an upper primer portion containing a primer in a primer holder, and a lower delay portion containing ignition, delay, and penetration charges, and an air gap separating the primer portion from the ignition charge. A flat, circular seal is interposed between the base of the primer and the primer holder. A first annular channel is defined between the primer holder and the delay case, and first annular seal is matingly received in the first annular channel. A second annular channel is defined between the delay case assembly and the bore, and a second annular seal is matingly received in the second annular channel. The bottom wall of the central portion of the fuze body has a third annular channel formed therein, and an annular gasket is matingly received in the third annular channel to provide a positive mechanical seal between the fuze body and the grenade.

The initiator lever assembly comprises an elongated initiator lever rotatably mounted at its proximal end to the fuze body head and a cover assembly removably mounted to the fuze body head using a hinge and hinge slot assembly. A rotatable safety latch is mounted on the cover assembly to maintain the initiator lever in its safe (unprimed) position. A projection on the initiator lever engages the safety latch to prevent its rotation. The projection disengages the safety latch when the initiator lever is squeezed in the direction of the grenade, allowing rotation of the safety latch to the armed position.

In one aspect of the invention, an interchangeable delay case assembly is provided for a practice fuze. The bottom of the fuze body stem is open, with the delay case assembly extending therethrough. The stem is then provided with a fourth annular channel formed in its inner surface and an annular retainer gasket matingly received in the fourth annular channel, which frictionally engages the delay case assembly.

In another aspect of the invention relating to practice fuze, the delay case assembly can further comprise an outer case for receiving the delay case. The outer case has an explosive material therein to provide increased output sound.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 1 is a perspective view of a first embodiment of the safety fuze of the invention;

FIG. 3 is a partial cross-sectional view of the safety fuze of FIG. 1, showing the safety catch of the safety fuze of FIG. 1 in its locked (safe) position;

FIG. 4 is a partial cross-sectional view of the safety fuze of FIG. 1, showing the safety catch in its unlocked (armed) position;

DETAILED DESCRIPTION OF THE PREFERRED EMBODIMENTS

Figure 2:
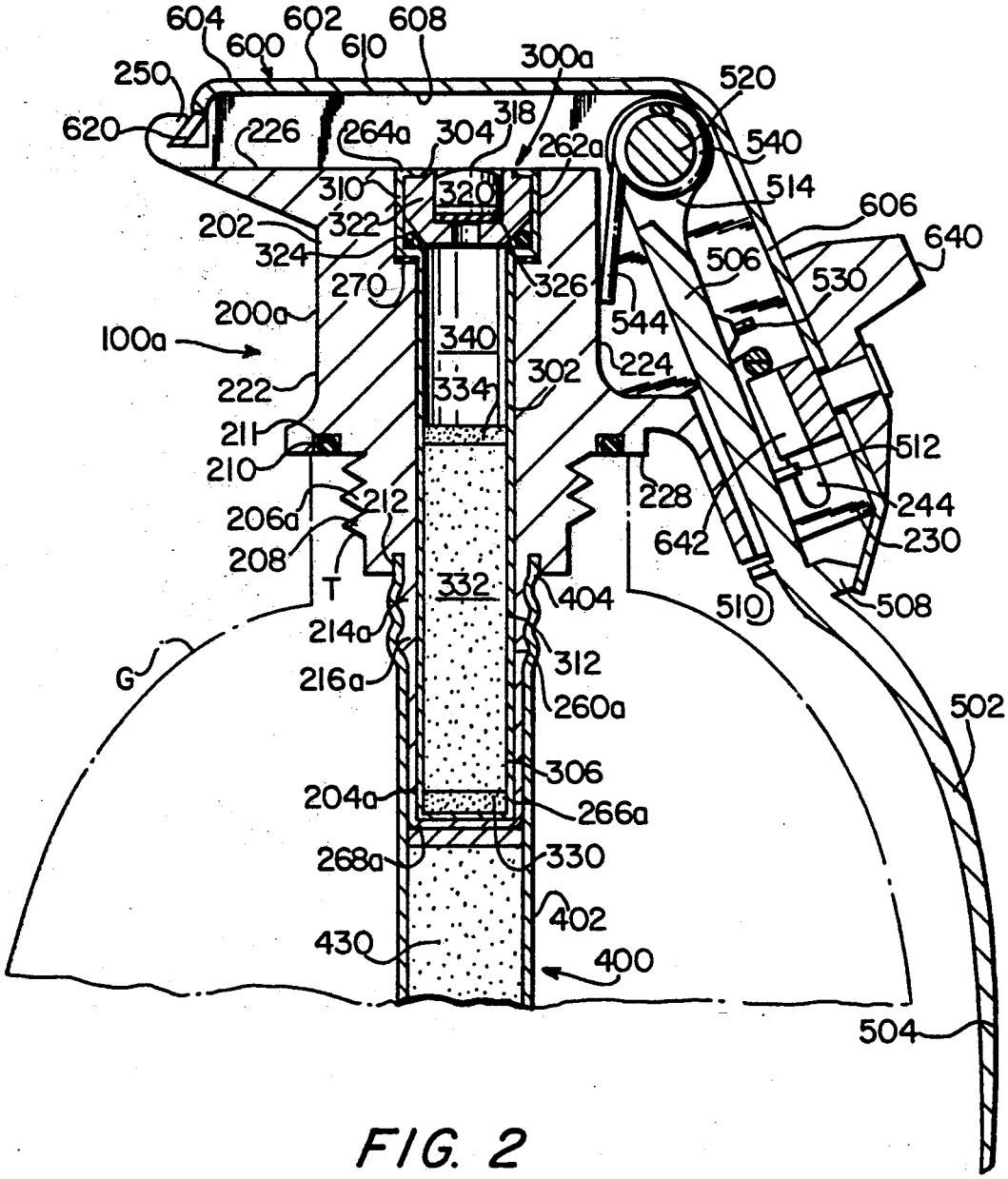
FIG. 2 is a cross-sectional view of the safety fuze of FIG. 1, taken along line 2—2 of FIG. 1.
Figure 5:
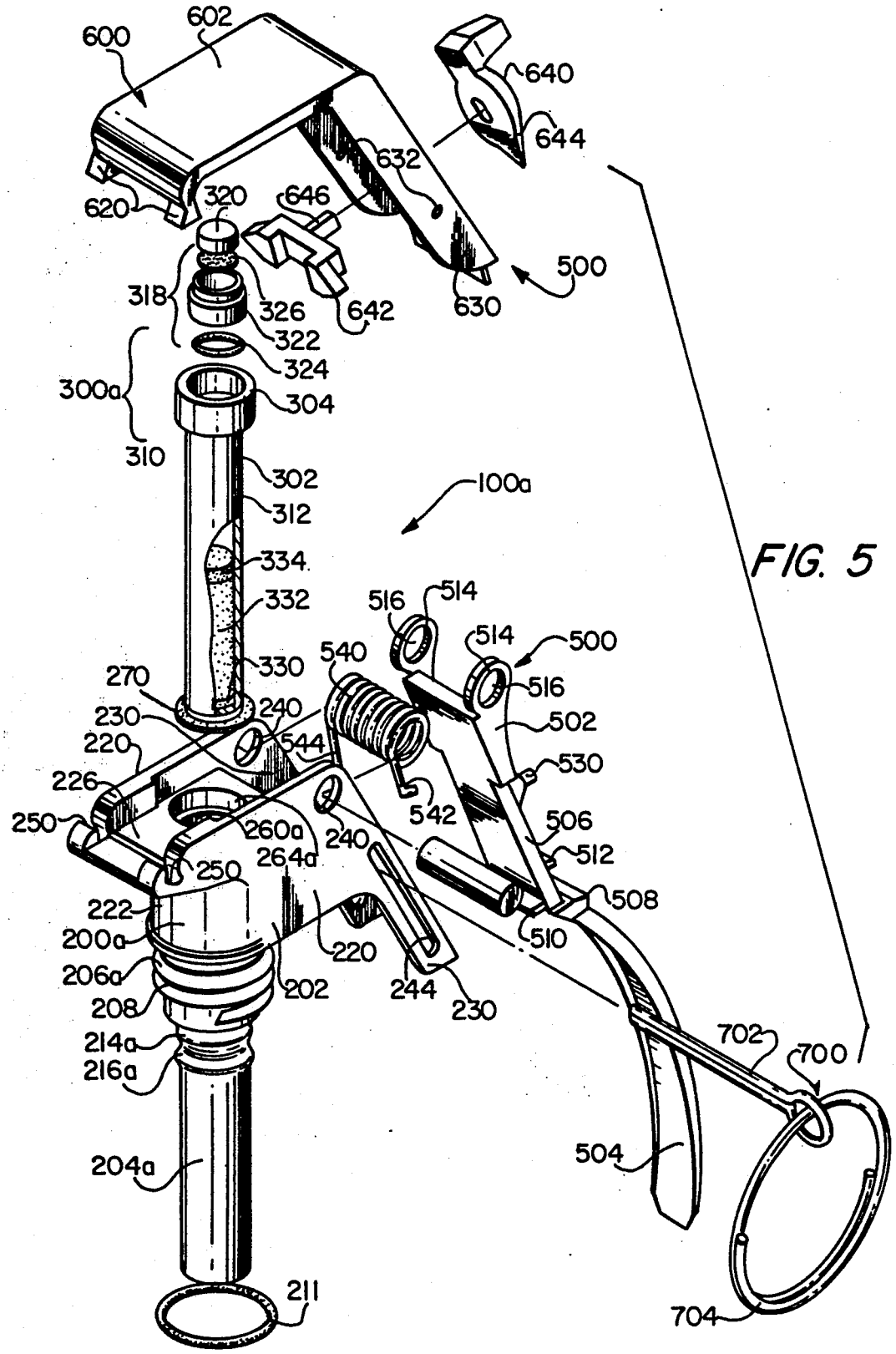
FIG. 5 is an exploded perspective view of the safety fuze of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIGS. 1-5, there is shown a first embodiment of a safety fuze 100*a* for a hand grenade G. Fuze 100*a* comprises a fuze body 200*a* having a head 202, a stem 204*a*, and a central portion 206*a* intermediate head 202 and stem 204*a*. Head 202, stem 204*a*, and central portion 206*a* are formed unitarily. Body 200*a* can be cast or molded, as can bodies 200*b* and 200*c* described hereinafter.

Head 202 is flared at the bottom to permit inclusion of an annular gasket retainer 210 for receiving an annular gasket or seal 211 This structure replaces a two-part assembly comprising a metal ring gasket retainer and gasket used in prior art grenades such as the M213 and M228.

Stem 204*a* adjacent central portion 206*a* is provided with raised upper and lower annular lips 214*a* and 216*a*, for a purpose to be described hereinafter. Lips 214*a* and 216*a* are formed as part of the die cast procedure for fuze body 200*a*. Lower lip 216*a* has a slightly smaller diameter than upper lip 214*a*; alternatively, lower lip 216*a* can have a slightly larger diameter than upper lip 214*a*, or their diameters can be the same.

Central portion 206*a* includes external threads 208 for engaging mating internal threads T at the top of grenade G. Central portion 206*a* also includes an annular undercut or groove 212*a* at the bottom thereof at the junction of stem 204a and central portion 206a, for a purpose to be described hereinafter.

Head 202 has a pair of opposed side walls 220 of substantially right trapezoidal profile, a front wall 220, a back wall 224 opposite front wall 222 and inset from the back edges of side walls 220, a top wall 226 inset from the top edges of side walls 220, and a bottom wall 228 opposite top wall 226. Side walls 220 include a pair of opposed, parallel extensions 230 extending downwardly from bottom wall 228. Side walls 220 also include an upper pair of opposed circular apertures 240 adjacent their back, upper corners, and a lower pair of opposed elongated slots 244 spaced downwardly from upper circular apertures 240 and extending into the extensions 230, all for a purpose to be described hereinafter. Front wall 222 includes a pair of spaced hinge slots 250 extending from the top thereof, also for a purpose to be described hereinafter.

A cylindrical bore 260a extends longitudinally through fuze body 200a. Cylindrical bore 260a has a top portion 262a terminating at an opening 264a in top wall 226 and a bottom portion 266a terminating at a closure 268a at the bottom of stem 204a. Bottom portion 266a has a smaller diameter than top portion 262a. A flat annular gasket or seal 270 is provided in bore 260a at the shoulder defined at the junction between bottom portion 266a and top portion 262a, for a purpose to be described hereinafter.

A delay case assembly 300a is matingly received in bore 260a and comprises a delay case 302 having a top 304 and a bottom 306, a primer portion 310 adjacent top 304, and a delay portion 312 adjacent bottom 306. Delay portion 312 is recessed inwardly from primer portion 310, primer portion 310 being matingly received in top portion 262a of bore 260a, and delay portion 312 being matingly received in bottom portion 266a of bore 260a. The inner diameters of top and bottom portions 262a and 266a of bore 260a are substantially identical to the outer diameters of top 304 and bottom 306, respectively, of delay case assembly 300a, to provide a close fit between delay case assembly 300a and bore 260a.

The inner and outer diameters of seal 270 are the same as the inner and outer diameters of the shoulder defined at the junction between delay portion 312 and primer portion 310. Seal 270 controls the free volume of internal air between delay case 302 and stem 204a. When fuze 100a functions, seal 270 prevents gases from escaping. Regulating this internal air volume controls functioning time uniformity.

Primer portion 310 of delay case assembly 300a houses a primer assembly 318 comprising a primer 320, a primer holder 322 rigidly holding primer 320 and chamfered at the bottom to receive a seal or gasket 324 of silicone or a similar material, a flat circular seal 326 of silicone or a similar material inserted between the bottom of primer 320 and primer holder 322, a penetration charge 330 positioned at bottom 306 of delay case 302, a delay charge 332 positioned immediately above penetration charge 330, an ignition charge 334 positioned immediately above delay charge 332, and an air gap 340 separating primer portion 310 from ignition charge 334.

The chamfer at the bottom of primer holder 322 at assembly defines with the bottom of primer portion 310 an annular groove for receiving gasket 270. This permits gasket 270 to flow toward the internal mating surfaces, thereby creating a positive internal seal.

The base of primer 320 is forced against and slightly embedded in flat circular seal 326. Internal seal 326 prevents moisture migration from delay portion 312 of delay case 302 into primer portion 310 and seals primer 320 and delay portion 312 against the entry of external moisture.

Delay case 302 and fuze body stem 204 are both closed at the bottom to prevent the flash from primer 320, when initiated, from penetrating delay case 302 and fuze body 204 and to provide sealed, double-walled protection between the pyrotechnic charges and the detonator case discussed hereinafter.

Primer portion 310 is crimped at top 304 of delay case 302 to retain primer holder 322a in primer portion 310. The crimped area can be coated with a sealant such as phenolformaldehyde varnish, type III, grade A or B, Spec. MIL-V-13750.

Penetration charge 330, delay charge 332, and ignition charge 334 are formulated and assembled substantially as described in our '752 patent. Air gap 340 provides expansion space for the low pressure hot gases produced by charges 330, 332, and 334. When ignited, penetration charge 330 will burn through bottom 306 of delay case 302 and closure 268a of bore 260a.

Stem 204a of fuze body 200a is matingly received in a detonator assembly 400 (shown in FIG. 1). Undercut 212a in central portion 206a of fuze body 200a permits the application of an internal sealant and a positive mechanical seal between the fuze body 200a and detonator case 400. At assembly, a bead of sealant (not shown) is applied into undercut 212a. Detonator assembly 400 is placed over stem 204a and pushed into undercut 212a, providing an interference fit. Detonator assembly 400 is then crimped as described in our '752 patent.

The structure of detonator assembly 400 is substantially as described in our '752 patent, and comprises a detonator case 402 having an open top 404 and a closed bottom (not shown). Detonator case 402 is crimped around lips 214a and 216a of fuze body stem 204a substantially as described in our '752 patent.

An initiator lever assembly 500 is mounted to fuze body 200a and rotatable between an unprimed position and a primed position. Initiator lever assembly 500 comprises an initiator lever 502 elongated to define a handle to be restrained while holding and throwing the grenade G and having a longitudinal plane of symmetry, a distal end 504, and a proximal end 506. Initiator lever 502 is substantially planar adjacent proximal end 506 and curved adjacent distal end 504.

Ribs 508 and 510 are formed integrally in the upper and lower surfaces of initiator lever 502 at the junction between the planar and curved portions. Upper rib 508 is positioned to close off the bottom of cover assembly 600 from contaminants such as mud. Lower rib 510 is positioned to act as a stop when initiator lever 5021 is squeezed towards grenade G, as will be described in greater detail hereinafter. A rib-like projection 512 is also formed integrally in the upper surface of initiator lever 502, forwardly of upper rib 508, for a purpose to be described hereinafter. Initiator lever assembly 500 can be cast, molded, or stamped.

A pair of opposed ears 514 extend from proximal end 506 of initiator lever 502 parallel to the plane of symmetry. Ears 514 include a pair of opposed circular apertures 516. Proximal end 506 of initiator lever 502 is positioned between side walls 220 of fuze body 200a with apertures 516 in ears 514 in registration with upper apertures 240 in side walls 220. A pin 520 is inserted through apertures 516 and apertures 240, allowing initiator lever 502 to rotate between a first position corresponding to the unprimed position of initiator lever assembly 500 and a second position corresponding to primed position of initiator lever assembly 500.

A firing pin 530 is formed integrally with initiator lever 502, firing pin 530 being positioned on initiator lever 502 to engage primer 320 when initiator lever 502 is in its second position and initiator lever assembly 502 is in its primed position. A coil spring 540 is mounted around pin 520, one end 542 of spring 540 extending outwardly and engaging initiator lever 502 and the other end 544 bearing against back wall 224*a* of fuze body head 204*a* to bias initiator lever 502 in its second position. Coil spring 540 is made from high tensile strength wire, such as rocket wire, available through the National Standard Company of Niles, Michigan, to withstand long periods of shelf life without reducing the reliability of its functioning capability.

Primer 320 is protected by a cover assembly 600, which also bears against initiator lever assembly 500 in its unprimed position. Cover assembly 600 comprises a cover piece 602 having the same longitudinal plane of symmetry as initiator lever 502 and having a top portion 604 covering the top of fuze body head 202, and a bottom portion 606 covering the back edges of side walls 220.

Top portion 604 includes at its front edge a pair of spaced hinges 620 which extend into and engage hinge slots 250, so that cover assembly 600 can be rotated by the user upwardly and forward of hinge slots 250 to permit initiator lever assembly 500 to be released from its unprimed position. The interlocking configuration of hinge slots 250 and hinges 620 prevents cover assembly 600 from freely sliding off of head 202.

Bottom portion 606 includes a pair of side extensions 630 extending substantially perpendicular to lower and upper surfaces 608 and 610. Side extensions 630 include a pair of opposed circular apertures 632 in registration with the upper ends of elongated slots 244 in side walls 220.

A rotatable safety latch 640 is mounted on bottom portion 606 of cover piece 602 for retaining initiator lever 502 in its unprimed position. Safety latch 640 comprises a pair of oppositely extending lugs 642 mounted below lower surface 608 of bottom portion 606 of cover piece 602 for engaging elongated slots 244, and a dial 644 mounted above upper surface 610 of bottom portion 606. Lugs 642 and dial 644 are operatively connected via a pin 646 extending through bottom portion 606 for rotation about the longitudinal axis of pin 646 between a locked position and an unlocked position.

Dial 644 has three positions, a central safe position, in which lugs 642 are locked in slots 244, and two armed positions, one to the left and one to the right of the safe position, in which lugs 642 are free of slots 244. The three positions can be identified by permanent markings such as the letters "A", "S", and "A" on the surface of cover piece 602. Dial 644 normally is prevented from rotating out of its central safety position by projection 512, which engages lugs 642 when initiator lever 502 is in the unprimed position. When initiator lever 502 is squeezed against the grenade, projection 512 moves below the plane of lugs 642, permitting dial 644 to be rotated into either of its armed positions.

Initiator lever 502 is further retained in its unprimed position by a pull ring assembly 700. Pull ring assembly 700 comprises an elongated cotter pin 702 or the like adapted to be inserted through the upper ends of lower elongated slots 244 in side walls 220 and circular apertures 632 in cover assembly 600 and a pull ring 704 for pulling cotter pin 702 out of slots 244 and apertures 632. When cotter pin 702 is in place, it further blocks movement of lugs 642 of safety latch 640, thus acting as a lock against accidental movement of safety latch 640.

In operation, to prepare grenade G to be thrown, pull ring assembly 700 is removed from safety fuze 100*a* by pulling on pull ring 704. Once cotter pin 702 has been removed from apertures 632 and slots 244, initiator lever 502 must be squeezed toward grenade G to permit safety latch 640 to be rotated to disengage lugs 642 from slots 244. All elements holding cover piece 602 in place are now removed and grenade G is prepared to be thrown. The fuze is now armed but safe, while the user keeps initiator lever 502 squeezed against grenade G. If the user reverses his decision to throw the grenade, he can easily reassemble cover assembly 600 and make it safe again. Otherwise, cover piece 602 is removed.

Upon release from the user's hand, spring 540 urges initiator lever 502 of initiator lever assembly 500 into its primed position. When initiator lever 502 reaches its primed position, firing pin 530 strikes against primer 320, causing it to actuate ignition charge 334. Ignition charge 334 ignites delay charge 332, which will burn for the desired period of time depending in a known manner on its length and composition. Delay charge 332 in turn ignites penetration charge 330, which burns through the closed bottom 306 of delay case 300*a* and the closed bottom 268 of fuze body stem 204 to ignite explosive charge 430 in detonator assembly 400.

Figure 6:
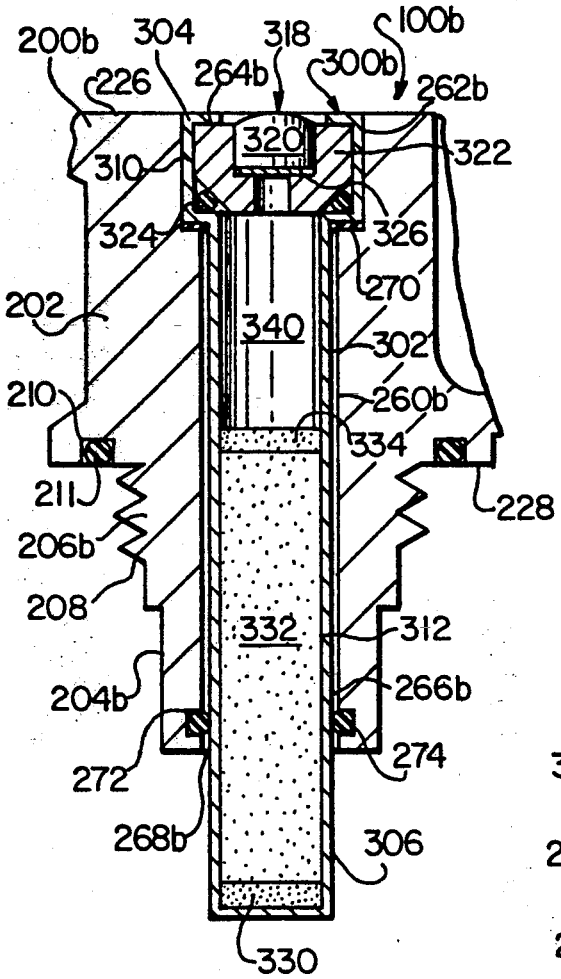
FIG. 6 is a cross-sectional view of a second embodiment of a fuze body and delay case assembly for a practice safety fuze according to the present invention.

Referring now to FIG. 6, there is shown a second embodiment of a fuze body 200*b* and a delay case assembly 300*b* for a practice safety fuze 100*b* for a practice hand grenade. Only those portions of safety fuze 100*b* which differ from safety fuze 100*a* are shown in FIG. 6 and will be described herein.

Fuze 100*b* comprises a unitary fuze body 200*b* having a head 202, a stem 204*b*, and a central portion 206*b* intermediate head 202 and stem 204*b*. Central portion 206*b* includes external threads 208 for engaging mating internal threads at the top of a practice grenade. Head 202 includes an annular undercut or groove 210 for receiving a circular gasket or seal 211 to provide a seal between the top of the practice grenade and fuze body 200*b*.

A cylindrical bore 260*b* extends longitudinally through fuze body 200*b*. Cylindrical bore 260*b* has a top portion 262*b* terminating at an opening 264*b* in top wall 226 and a bottom portion 266*b* terminating at an opening 268*b* at the bottom of stem 204*b*. Bottom portion 266*b* has a smaller diameter than top portion 262*b*.

A flat annular gasket or seal 270 is provided in bore 260*b* at the shoulder defined at the junction between bottom portion 266*b* and top portion 262*b*, for a purpose to be described hereinafter. The inner and outer diameters of seal 270 are the same as the inner and outer diameters of the shoulder defined at the junction between bottom portion 266*b* and top portion 262*b*.

An annular channel 272 is provided in the inner wall of bottom portion 266*b* adjacent open bottom 268*b*, for receiving a retaining mechanism such as an annular retainer gasket or seal 274, for a purpose to be described hereinafter.

A delay case assembly 300*b* identical to delay case assembly 300*a* described above with respect to FIGS. 1-5 is received in bore 260*b*. Bottom 306 of delay case assembly 300*b* extends through the open bottom 268*b* of stem 204*b*. The bottom portion 266*b* of bore 260*b* has a slightly larger diameter than bottom 306 of delay case assembly 300*b*, to provide a slip fit between delay case assembly 300*b* and bore 260*b*. Retainer gasket 274 provides frictional engagement with the outer wall of bottom 306 of delay case assembly 300*b*. Thus, a delay case assembly 300*b* can easily be inserted into bore 260*b* and will be retained therein by retainer gasket 274; and once expended, can be removed from bore 260*b* by pushing it out through a hole in the bottom of the practice grenade.

Figure 7:
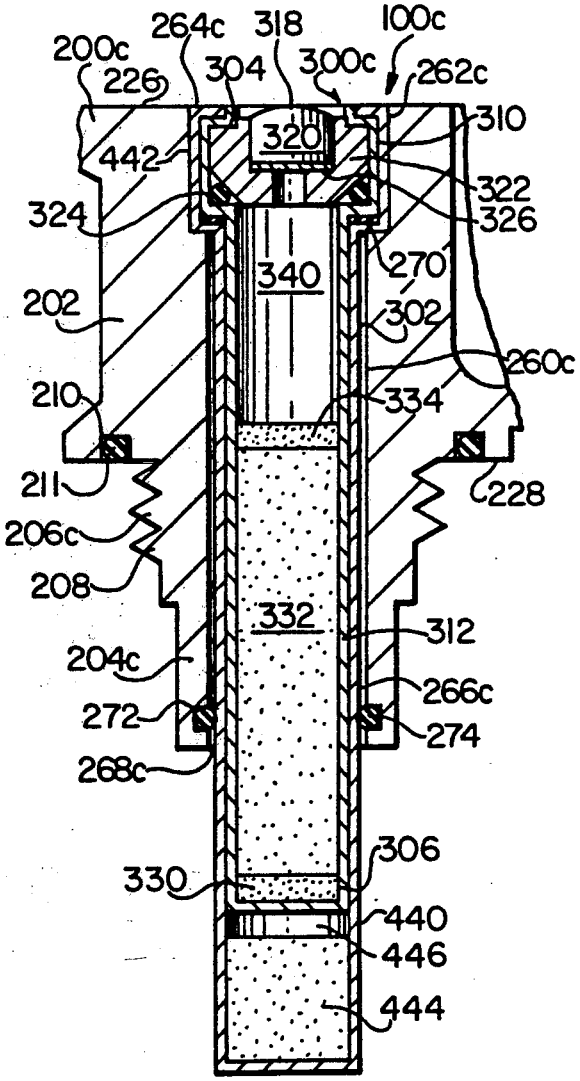
FIG. 7 is a cross-sectional view of a third embodiment of a fuze body and delay case assembly for a practice safety fuze according to the present invention.

Referring now to FIG. 7, there is shown a third embodiment of a fuze body 200*c* and delay case assembly 300*c* for a safety fuze 100*c* for a practice hand grenade. Only those portions of safety fuze 100*c* which differ from safety fuze 100*a* are shown in FIG. 7 and will be described herein.

Fuze 100*c* comprises a unitary fuze body 200*c* having a head 202, a stem 204*c*, and a central portion 206*c* intermediate head 202 and stem 204*c*. Central portion 206*c* includes external threads 208 for engaging mating internal threads T at the top of the practice grenade. Head 202 includes an annular undercut or groove 210 for receiving an annular gasket or seal 211 to provide a seal between the top of the practice grenade and fuze body 200*c*.

A cylindrical bore 260*c* extends longitudinally through fuze body 200*c*. Cylindrical bore 260*c* has a top portion 262*c* terminating at an opening 264*c* in top wall 226 and a bottom portion 266*c* terminating at an opening 268*c* at the bottom of stem 204*c*. Bottom portion 266*c* has a smaller diameter than top portion 262*c*.

An annular channel 272 is provided in the inner wall of bottom portion 266*c* adjacent open bottom 268*b*, for receiving a retaining mechanism such as an annular retainer gasket or seal 274, for a purpose to be described hereinafter.

Delay case assembly 300*c* is identical to delay case assemblies 300*a* and 300*b* described above with respect to FIGS. 1–6, except for the provision of an outer case 440 which receives delay case 302. Outer case 440 includes a top 442 and a bottom 444 recessed inwardly from top 442 to define a shoulder. In the embodiment of FIG. 7, flat annular gasket or seal 270 is provided between primer portion 310 of delay case 302 and top 442 of outer case 440.

Outer case 440 is longer than delay case 302, its length being variable, depending on specific needs. A cavity 446 is defined in outer case 440 below delay case 302. Cavity 446 is filled with an explosive material 448 to provide an output sound consistent with specific requirements.

Delay case 302 is inserted into outer case 440 until gasket 270 and the shoulder defined at the junction between delay portion 312 and primer portion 310 seat firmly. Outer case 440 is then crimped over delay case 302, thus completing delay case assembly 300*c*.

The complete delay case assembly 300*c*, including outer case 440, is received in bore 260*c*. Bottom 306 of delay case assembly 300 extends through the open bottom 268*c* of stem 204*c*. The bottom portion 266*c* of bore 260*c* has a slightly larger diameter than bottom 306 of delay case assembly 300, to provide a slip fit between delay case assembly 300 and bore 260*c*. Retainer gasket 274 provides frictional engagement with the outer wall of bottom 306 of delay case assembly 300. Thus, a delay case assembly 300 can easily be inserted into bore 260*c* and will be retained therein by retainer gasket 274; and once expended, can be removed from bore 260*c* by pushing it out through a hole in the bottom of the practice grenade.

Modifications and variations of the above-described embodiments of the present invention are possible, as appreciated by those skilled in the art in light of the above teachings. It is therefore to be understood that within the scope of the appended claims and their equivalents, the invention may be practiced otherwise than as specifically described.

What is claimed is:

1. A fuze for a hand grenade comprising:

(a) a fuze body having a top having a recess therein, a bottom, a head adjacent said fuze body top, a stem adjacent said fuze body bottom, and a central portion intermediate said fuze body head and stem, and a bore extending longitudinally therethrough, said recess having an opening therein, said opening in said recess defining the top of said bore and said fuze body bottom defining the bottom of said bore; and (b) a delay case assembly matingly received in said bore and comprising:

a delay case having a top and a bottom, a primer portion adjacent said top, and a delay portion adjacent said bottom;

a primer holder positioned in said primer portion, said primer portion having an upper surface, said upper surface having a recess therein, and said recess having a base;

a primer seal positioned in said base of said recess;

a primer positioned in said primer holder above said primer seal;

a penetration charge positioned at said bottom of said delay case;

a delay charge positioned above said penetration charge;

an ignition charge positioned above said delay charge; and an air gap separating said seal from said ignition charge.

2. The fuze of claim 1, further comprising an annular channel defined between said delay case assembly and said bore, and an annular seal matingly received in said annular channel.

3. The fuze of claim 1, said central portion of said fuze body having a bottom wall, said bottom wall having an annular channel formed therein, and said fuze body further having an annular gasket matingly received in said annular channel.

4. The fuze of claim 1, said bottom of said fuze body being open, said stem having an annular channel formed in its inner surface and an annular gasket matingly received in said annular channel, said annular gasket frictionally engaging said delay case assembly, and said delay case assembly extending through said open bottom of said fuze body.

5. The fuze of claim 1, further comprising a detonator assembly having an open top, and wherein said central portion includes an annular groove at the bottom thereof at the junction of said central portion and said stem, and wherein said stem is received in said detonator assembly through said open top of said detonator assembly and said open top of said detonator assembly is matingly received in said annular groove in said central portion.

6. The fuze of claim 1, said delay case assembly further comprising an annular channel defined between said primer holder and said delay case, and an annular seal matingly received in said annular channel.

7. The fuze of claim 6, wherein said primer holder is chamfered to define said annular channel between said primer holder and said primer portion of said delay case.

8. The fuze of claim 1, said delay case assembly further comprising an outer case for receiving said delay case.

9. The fuze of claim 8, said delay case assembly further comprising an annular channel defined between said delay case and said outer case adjacent said primer portion, and an annular seal matingly received in said annular channel.

10. The fuze of claim 1, further comprising:

(c) an initiator lever assembly mounted on said fuze body and rotatable between an unprimed position and a primed position, comprising:

an elongated initiator lever being rotatable between a first position corresponding to said unprimed position and a second position corresponding to said primed position, said initiator lever having a longitudinal plane of symmetry, a distal end, a proximal end positioned between said extensions of said fuze head, a firing pin positioned on said proximal end to engage said primer when said initiator lever assembly is in said primed position, and a raised projection on said proximal end spaced from said firing pin;

mounting means for mounting said proximal end of said initiator lever to said fuze body head adjacent said fuze body top for rotation about an axis perpendicular to said plane of symmetry of said initiator lever between said first position and said second position; and biasing means for biasing said initiator lever in said second position; and (d) a cover assembly comprising:

a cover piece having a top portion covering said fuze body top and a bottom portion extending over said back edges of said fuze body side walls and covering said extensions; and safety latch means mounted on said bottom portion of said cover piece movable between a first position for retaining said initiator lever in said first position by engaging a portion of said elongated apertures in said extensions and a second position for permitting movement of said initiator lever into said second position, said safety latch means engaging said projection when in said first position.

11. The fuze of claim 10, said front wall of said head including a pair of spaced hinge slots extending forwardly therefrom, and said top portion of said cover piece including a pair of spaced hinges which extend into and engage hinge slots, whereby said cover assembly can be rotated by a user upwardly and forward of said hinge slots to permit said initiator lever assembly to be released from said unprimed position.

12. The fuze of claim 10, wherein said initiator lever includes rib means extending outwardly therefrom for closing off said bottom portion of said cover piece from contaminants.

13. A fuze for a hand grenade comprising:

(a) a fuze body having a top, a bottom, a head adjacent said fuze body top, a stem adjacent said fuze body bottom, and a central portion intermediate said fuze body head and stem, and a bore extending longitudinally therethrough, said head having a pair of opposed front and back walls and a pair of opposed side walls, said side walls including a pair of opposed, parallel extensions, and said extensions having a pair of opposed, elongated slots therein;

(b) a primer positioned in said bore at said top of said fuze body;

(c) an initiator lever assembly mounted on said fuze body and rotatable between an unprimed position and a primed position, comprising:

an elongated initiator lever being rotatable between a first position corresponding to said unprimed position and a second position corresponding to said primed position, said initiator lever having a longitudinal plane of symmetry, a distal end, a proximal end positioned between said extensions of said fuze head, a firing pin positioned on said proximal end to engage said primer when said initiator lever assembly is in said primed position, and a raised projection on said proximal end spaced from said firing pin;

mounting means for mounting said proximal end of said initiator lever to said fuze body head adjacent said fuze body top for rotation about an axis perpendicular to said plane of symmetry of said initiator lever between said first position and said second position; and biasing means for biasing said initiator lever in said second position;

(d) a cover assembly comprising:

a cover piece having a top portion covering said fuze body top and a bottom portion extending over said back edges of said fuze body side walls and covering said extensions; and safety latch means mounted on said bottom portion of said cover piece movable between a first position for retaining said initiator lever in said first position by engaging a portion of said elongated apertures in said extensions and a second position for permitting movement of said initiator lever into said second position, said safety latch means engaging said projection when in said first position.

14. The fuze of claim 13, said front wall of said head including a pair of spaced hinge slots extending forwardly therefrom, and said top portion of said cover piece including a pair of spaced hinges which extend into and engage hinge slots, whereby said cover assembly can be rotated by a user upwardly and forward of said hinge slots to permit said initiator lever assembly to be released from said unprimed position.

15. The fuze of claim 13, wherein said initiator lever includes rib means extending outwardly therefrom for closing off said bottom portion of said cover piece from contaminants.

16. A fuze for a hand grenade comprising:

(a) a fuze body having a top having a recess therein, a bottom, a head adjacent said fuze body top, a stem adjacent said fuze body bottom, and a central portion intermediate said fuze body head and stem, and a bore extending longitudinally therethrough, said recess having an opening therein, said opening in said recess defining the top of said bore and said fuze body bottom defining the bottom of said bore, said central portion of said fuze body having a bottom wall, said bottom wall having an annular channel formed therein, and said fuze body further having sealing means therein for forming a seal between said fuzed body and the grenade; and (b) a delay case assembly matingly received in said bore and comprising:

a delay case having a top and a bottom, a primer portion adjacent said top, and a delay portion adjacent said bottom;

a primer holder positioned in said primer portion, said primer portion having an upper surface, said upper surface having a recess therein, and said recess having a base;

a primer holder seal positioned between said primer holder and said primer portion of said delay case;

a primer seal positioned in said base of said recess;

a primer positioned in said primer holder above said primer seal;

at least one charge positioned at said bottom of said delay case; and an air gap separating said primer seal from said at least one charge.

17. The fuze of claim 16, further comprising a delay case seal positioned between said delay case and said bore.

18. The fuze of claim 16, said delay case assembly further comprising an outer case for receiving said delay case and a delay case seal positioned between said delay case and said outer case.

19. The fuze of claim 16, further comprising:

(c) an initiator lever assembly mounted on said fuze body and rotatable between an unprimed position and a primed position, comprising:

an elongated initiator lever being rotatable between a first position corresponding to said unprimed position and a second position corresponding to said primed position, said initiator lever having a longitudinal plane of symmetry, a distal end, a proximal end positioned between said extensions of said fuze head, a firing pin positioned on said proximal end to engage said primer when said initiator lever assembly is in said primed position, and a raised projection on said proximal end spaced from said firing pin;

mounting means for mounting said proximal end of said initiator lever to said fuze body head adjacent said fuze body top for rotation about an axis perpendicular to said plane of symmetry of said initiator lever between said first position and said second position; and biasing means for biasing said initiator lever in said second position; and (d) a cover assembly comprising:

a cover piece having a top portion covering said fuze body top and a bottom portion extending over said back edges of said fuze body side walls and covering said extensions; and safety latch means mounted on said bottom portion of said cover piece movable between a first position for retaining said initiator lever in said first position by engaging a portion of said elongated apertures in said extensions and a second position for permitting movement of said initiator lever into said second position, said safety latch means engaging said projection when in said first position.

20. The fuze of claim 19 said front wall of said head including a pair of spaced hinge slots extending forwardly therefrom, and said top portion of said cover piece including a pair of spaced hinges which extend into an engage hinge slots, whereby said cover assembly can be rotated by a user upwardly and forward of said hinge slots to permit said initiator lever assembly to be released from said unprimed position.

21. The fuze of claim 19 wherein said initiator lever includes rib means extending outwardly therefrom for closing off said bottom portion of said cover piece from contaminants.

* * * * *